United States Patent [19]

Lusk

[11] Patent Number: 4,489,935

[45] Date of Patent: Dec. 25, 1984

[54] WEIGHT LIFTING APPARATUS FOR ARM DEVELOPMENT AND CONDITIONING

[76] Inventor: Jewell D. Lusk, 3516 Roland Ave., Baltimore, Md. 21211

[21] Appl. No.: 468,049

[22] Filed: Feb. 22, 1983

[51] Int. Cl.[3] ..... A63B 21/06

[52] U.S. Cl. ..... 272/117; 272/143; 272/67

[58] Field of Search ..... 272/117, 119, 93, 122, 272/123, 143

[56] References Cited

U.S. PATENT DOCUMENTS

| | | | |
|---|---|---|---|
| 90,305 | 5/1869 | Reilly | 272/143 |
| 3,751,031 | 8/1973 | Yamauchi | 272/143 X |
| 4,220,333 | 9/1980 | Mercer | 272/119 X |
| 4,345,756 | 8/1982 | Hoagland | 272/117 |

*Primary Examiner*—Richard J. Apley
*Assistant Examiner*—William R. Browne
*Attorney, Agent, or Firm*—Walter G. Finch

[57] ABSTRACT

A device for developing the arm muscles and the general condition of the arm. It is a structure that will develop the power of the arm, both in the forearm, including the wrist, and in the the upper arm. It is particularly suited for developing the arm for the power and technique required in arm wrestling and in making power lifts. The apparatus has a cuff-like shackle component to fit over the forearm, with an attached hand grip member, a holding pedestal for weights, a plurality of weights to fit on the holding pedestal, and a flexible connecting member to connect the cuff-like shackle component to the holding pedestal. The cuff-like shackle component has a positioning member built into the structure to which the flexible connecting member is removably and slideably affixed. The positioning member is arranged so that the flexible connecting member may be conveniently and quickly reset in three different positions for three changes in exercises while the user is utilizing the cuff-like shackle component.

10 Claims, 4 Drawing Figures

WEIGHT LIFTING APPARATUS FOR ARM DEVELOPMENT AND CONDITIONING

BACKGROUND AND SUMMARY OF THE INVENTION

The invention relates to gymnastic equipment and in particular to exercise apparatus. Specifically, it relates to apparatus for arm exercising for muscle development and conditioning in preparation for arm wrestling and power lifting.

In the prior art arm exercising has been limited to general calisthenics, without the use of any apparatus or equipment, or to the use of simple devices such as dumb-bells, bar-bells, weighted pulleys, rowing machines, chinning bars, parallel bars, and other such means. None of these devices were specifically designed to develop the arms for arm wrestling techniques or for making power lifts. The present invention fills in this void in the line of arm development and conditioning equipment.

The calisthenics and exercising equipment of the prior art did develop and condition the muscles of the arm. However, when the arms are to be used for arm wrestling and for making power lifts, it is necessary to enhance the development and conditioning of the arms beyond that attained by the prior art methods and equipment. The apparatus of the present invention meets this requirement.

The present apparatus is portable with little effort to move it and easy to set up. It also stores compactly in a minimum of space, making it convenient for home use as well as for use in gymnasiums and similar places for physical development and exercising. It may be used on either the right or left arm.

The structure of the present invention consists of a cuff-like shackle component to fit over the forearm, with an attached hand grip member, a holding pedestal for weights, a plurality of weights to fit on the holding pedestal, and a flexible connecting member to connect the cuff-like shackle component to the holding pedestal.

The cuff-like shackle component has a positioning member built into the structure to which the flexible connecting member is removably and slideably affixed. The positioning member is arranged so that the flexible connecting member may be conveniently and quickly reset in three different positions for three changes in exercises while the user is utilizing the cuff-like shackle component.

The structure of the present invention will develop power of the arm, both in the forearm, including the wrist, and in the upper arm.

It is particularly suited for developing the arm for the power and technique required in arm wrestling and in making power lifts.

It is, therefore, an object of this invention to provide an apparatus that is simple to set up and simple to use.

It is another object of this invention to provide an apparatus that enhances the exercises that build and condition the muscles of the arm.

It is also an object of this invention to provide an apparatus that can be used in the home as well as in a gymnasium.

It is yet another object of this invention to provide an apparatus that is portable and easy to move and transport.

It is still another object of the invention to provide an apparatus that may be used for either the right or left arm.

Further objects and advantages of the invention will become more apparent in light of the following description of the preferred embodiments.

DESCRIPTION OF THE PREFERRED EMBODIMENTS

Figure 1:
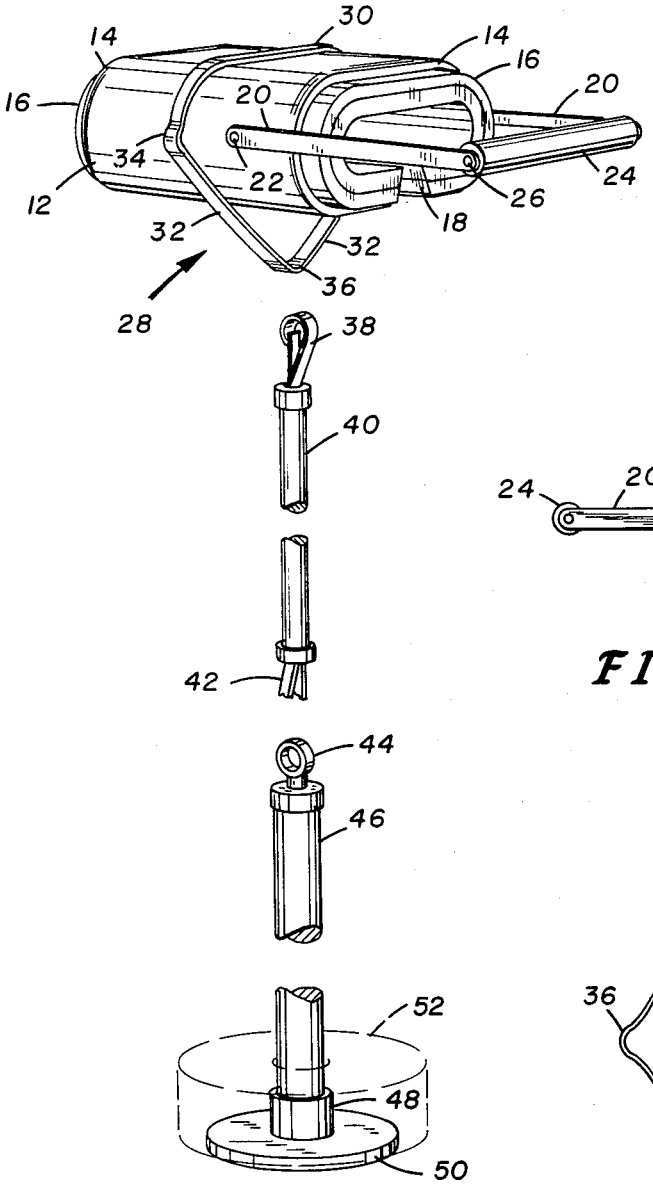
FIG. 1 is a perspective view of an apparatus for arm development and conditioning.

Referring now to the drawings and particularly to FIG. 1, an apparatus for arm development and conditioning is shown at 10.

The apparatus for arm development and conditioning 10 consists of a cuff-like shackle component 28, a holding pedestal 46 for weights, a plurality of weights 52, and a flexible connecting means 40. The details of each of these components that make up the total structure of the apparatus for arm development and conditioning 10 are described hereinafter.

The cuff-like shackle component 28 consists of a "C" shaped enclosure means 12, a hard primary liner means 54, a soft secondary liner means 56, a hand grip means 24, a pair of support means 20, a pair of pivotable connector means 22, and a positioning member 32. The cooperation with each other of the aforementioned elements of the cuff-like shackle component 28 is described hereinafter.

The "C" shaped enclosure means 12 serves as the main frame means for the cuff-like shackle component 28. The "C" shaped enclosure means 12 is preferably made of a very hard and strong light-weight material, such as a reinforced plastics, but may be made of aluminum or any other metal or other material. Such a variation of materials for the "C" shaped enclosure means 12 is within the scope and intent of the invention.

Inside the "C" shaped enclosure means 12 and interfacing therewith, is a "C" shaped hard primary liner means 54. The outside surface of the "C" shaped hard primary liner means 54 is suitably affixed to the inside surface of the "C" shaped enclosure means, such as by an adhesive, riveting, or other suitable fastening means. The affixing means is not numbered on the drawing. The "C" shaped hard primary liner means 54 may be of hard rubber or hard rubber-like material or other similar hard material that has some resiliency.

The protruding end 14 of the "C" shaped hard primary liner means 54 extends slightly beyond the outer edges, on each end, of the "C" shaped enclosure means 12 in order to shield the arm of the user against contact with the vary hard "C" shaped enclosure means 12.

Inside of the "C" shaped hard primary liner means 54, and interfacing therewith, is a "C" shaped soft secondary liner means 56. The outside surface of the "C" shaped soft secondary liner means 56 is suitably affixed to the inside surface of the "C" shaped hard primary liner means 54, such as by an adhesive, or other suitably fastening means. The affixing means is not numbered on the drawing. The "C" shaped soft secondary liner means may be of soft rubber, sponge rubber, or similar soft synthetic or other soft materials that has good comfortable qualities as this "C" shaped secondary liner means 56 is next to the arm of the user when being used, as hereinafter described.

The protruding end 16 of the "C" shaped soft secondary liner means 56 extends slightly beyond the outer edges (protruding ends 14), on each end, of the "C" shaped hard primary liner means 54 in order to further shield the arm of the user against contact with the "C" shaped hard primary liner means 54.

Both of the primary liner means 54 and the secondary liner means 56, in the protruding ends 14 and 16 respectively, effectively extend beyond and cover the edges of the enclosure means 12 and the primary liner means 54 in that order respectively. The protruding extensions may also include protrusion over the bottom edges as well.

The two support means 20 are centrally located on each side of the cuff-like shackle component 28, one support means 20 on each side, and pivotally affixed to the "C" shaped enclosure means 12 by the pivotable connector or fastening means 22. The support means 20 may be of any light-weight material such as aluminum or reinforced plastics or other suitable material.

It is to be understood, however, that the use of heavier materials for the support means 20 and the use of a non-pivoting connector or fastening means 22 are all within the scope and intent of this invention.

A cylindrical hand grip means 24 is pivotally affixed to and between the distal ends of the two support means 20. The hand grip means 24 is pivotally affixed to the support means 20 with pivotal fastening means 26.

The hand grip means 24 is rod-like and may be of a plastics, wood, metal, or any other suitable material. The pivotal fastening means 26 may be rod-like and passing through a passageway through the hand grip means 24 with a securing means on each end, or it may be captive stud-like means affixed in the support means 20 with ends of the studs projecting pivotally into the ends of the hand grip means 24, or any suitable means to accomplish the free pivoting movement of the hand grip means 24. It is to be understood, however, that a non-pivoting hand grip means 24 and non-pivotable fastening means 26 are both within the scope and intent of this invention.

Figure 2:
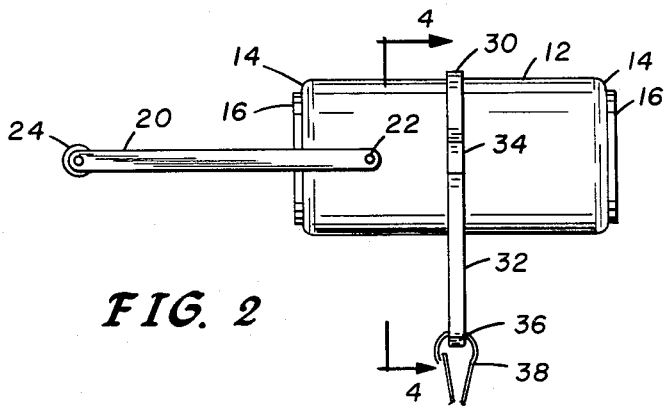
FIG. 2 is a partial side view of an apparatus for arm development and conditioning.

The references herein to sides, top, and bottom of the cuff-like shackle component 28 refer to its position as shown in FIGS. 1 and 2 when the open part 18 of the "C" shape is downward. The open part 18 exists in all three "C" shaped elements, the enclosure means 12, the hard primary liner means 54, and the soft secondary liner means 56. The open part 18 in these "C" shaped elements can be seen more clearly in FIGS. 3 and 4.

The positioning member 32 encircles the outside of the "C" shaped enclosure means 12. The top portion 30 of the positioning member 32 located transversely and suitably affixed to the longitudinal length of the top portion of the "C" shaped enclosure means 12. It may be affixed by an adhesive, welding or brazing (when metal parts are used), riveting or by any other suitable fastening means. The fastening means for affixing the positioning member 32 to the "C" shaped enclosure means 12 is not numbered on the drawings. The positioning member 32 is rectangular in cross section.

Figure 3:
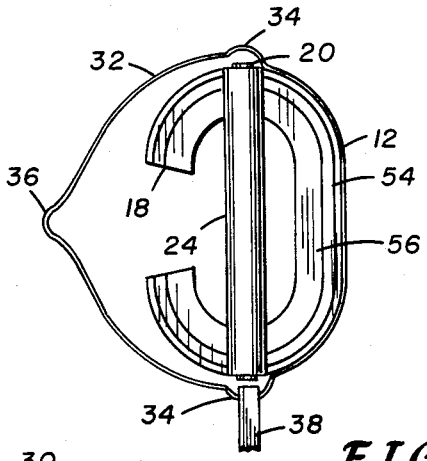
FIG. 3 is a partial end view of FIG. 2.
Figure 4:
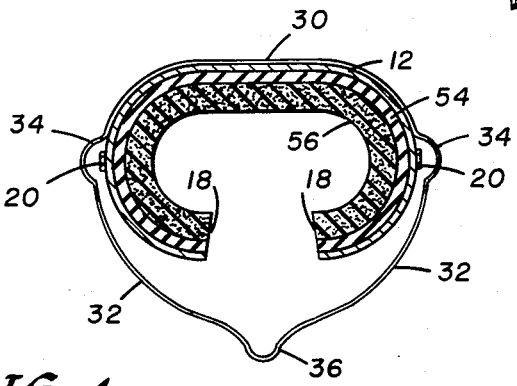
FIG. 4 is a partial cross-sectional view of FIG. 2 taken on line 4–4.

Note in FIG. 3 that beyond the top portion of the "C" shaped enclosure means 12, the positioning member 32 encircling the "C" shaped enclosure means 12, is spaced from the "C" shaped enclosure means 12. In the configuration of the portion that is spaced from the "C" shaped enclosure means 12 note in FIG. 3 that the widest clearance from the "C" shaped enclosure means is at the bottom opposite the open part 18 of the cuff-like shackle component 28.

In the clearance portion of the positioning member 32 there are three position offsets. Two are side position offsets 34, one on each side, and one is a bottom position offset 36. These position offsets permit a first connecting link means 38, described hereinafter, to be slidingly moved on the positioning member 32 from one offset position to another without removing or disconnecting the first connecting link means 38. The first connecting link means 38 is shown in FIG. 1, and partially in FIGS. 2 and 3.

Referring to FIG. 1, the flexible connecting means 40 has a fixed connecting link means 38 at one end thereof and a second connecting link means 42 at the other end thereof. The first connecting link means 38 is removably and slidingly affixed to and around the positioning member 32 so that it can slide from either of the position offsets 34 to position offset 36 and back again freely when desired and for purposes as hereinafter described. The first and second connecting link means 38 and 42 are snap-type connectors, such as harness hooks.

The flexible connecting means 40 may be leather, chain, cable, rope, plastics (such as Nylon), or any other suitable flexible material. The first and second connecting links 38 and 42, respectively, may be snap-type connectors, as illustrated in FIG. 1, however, any other suitable connecting link means may be used.

The remaining elements of the apparatus for arm development and conditioning 10 are shown in FIG. 1. The holding pedestal 46 has a connecting loop or eye 44 at the uppermost end thereof to which the aforementioned second connecting link means 42 is removably affixed when in use.

The holding pedestal 46 has a flange 50 at the lowermost or distal end of the holding pedestal 46. The flange is flat and plate-like and may be square, round or disc-like, or any suitable configuration. The flange 50 is secured to the holding pedestal 46 by use of a collar 48. It is to be understood, however, that the flange 50 may be secured directly to the holding pedestal 46 by suitable affixing means, such as by welding or brazing, or by riveting or by screw threads. Similar methods may be used to assemble the elements when using the collar 48. The holding pedestal 46 is cylindrical and may be solid or tube or pipe-like.

A plurality of weights 52, shown in phantom lines in FIG. 1, provides a means of varying the total weight lifted or used in the arm development and conditioning. The weights 52 may be varied in size and weight in order to provide a flexible range of total weight used in the exercises for arm development and conditioning when using the apparatus for arm development and conditioning 10.

The flexible connecting means 40 may be made adjustable in length or provided in a range of lengths to provide for a variation in the lengths for users. When the elements, as described hereinbefore, are assembled into the total structure of the apparatus for arm development and conditioning 10, the overall height must be suitably related to the user.

When in use the user inserts the forearm through the central opening or passageway through the "C" shaped soft secondary liner 56 and grasps the hand grip means 24 with the hand. The forearm may also be inserted through the open part 18 if the forearm development is less than the width or clearance of the open part 18.

With the forearm inserted in the cuff-like shackle component 28 and with the hand gripping the hand grip means 24 the flange 50 should clear the floor sufficiently when the forearm is raised or brought up to a horizontal position more or less parallel with the floor.

Most exercises for arm development and conditioning move from and above such a horizontal position, so that sufficient clearance of the floor by the flange 50 is important for satisfactory use. If the clearance for any exercise is not great enough the flexible connecting means 40 must be adjusted or a shorter length flexible connecting means 40 used.

Exercise programs with varying weights can be arranged by adding various arrangements of the plurality of weights 52 on the holding pedestal 46. The weights 52 can be varied in thickness or diameter to provide a range of weight combinations. The weights may be slotted (straight slot or curved slot) to make them easy to assemble on the holding pedestal 46 or they may be made with a single aperture in the center as shown in FIG. 1, but not numbered. The single centrally located aperture is the safest and preferred embodiment to prevent weights 52 from sliding off and causing an injury. The weights 52 are removably assembled on the holding pedestal 46.

Three principle movements with the apparatus for arm development and conditioning 10 are normally used.

First, with the arm inserted in the cuff-like shackle means 28 and the hand gripping the hand grip means 24 with the palm of the hand on the bottom of the hand grip means 24, palm facing upwardly, the forearm is raised or flexed and lowered, a movement usually referred to as a curl.

Second, in a similar manner to the first movement, but with the palm of the hand gripping the top of the hand grip means 24, palm facing downwardly, the forearm is raised and lowered.

Third, in a similar manner of grasping the hand grip means 24, but then rotating the forearm 90° so that the palm of the hand faces the medial direction or inwardly toward the body. The forearm is then raised and lowered as before, a movement usually referred to as a hammer.

Other arm development and conditioning movements can be varied from the aforementioned three principle basic positions. For example, with the arm raised to the position parallel to the floor, the upper arm can be moved backwardly at the shoulder and then returned to the original position. Similarly, the upper arm can be moved laterally at the shoulder horizontal position and then returned to the original position. Other exercises can be done with the forearm straight, parallel with the upper arm, making similar movements as aforementioned.

Regarding the three principle positions mentioned, when the first and second positions are used, the first connecting link means 38 slidingly comes to rest in the bottom position offset 36. When the third position is used the first connecting link means 38 easily and quickly slides along the positioning member 32 and comes to rest in one of the side position offsets 34. As to which side position offset 34 depends upon whether the apparatus is being used for the right arm or for the left arm. The apparatus is reversible for either arm. It is to be understood that it is within the scope and intent of the invention to also use two structures of apparatus for arm development and conditioning 10 at the same time, one for each arm.

It is to be noted that in normal use of the apparatus the lateral side of the forearm, the outside, is adjacent to and interfacing with the inside of the "C" shaped soft secondary liner means 56. However, it is to be understood that using the apparatus in a manner so that the lateral side of the forearm is facing the open part 18 of the cuff-like shackle component 28, is within the scope and intent of the invention.

As can be readily understood from the foregoing description of the invention, the present structure can be configured in different modes to provide the ability to exercise the arm for development and conditioning.

Accordingly, modifications and variations to which the invention is susceptible may be practiced without departing from the scope and intent of the appended claims.

What is claimed is:

1. An apparatus, comprising:

an outer enclosure means, said outer enclosure means being a housing member, said outer enclosure means being "C" shaped in configuration, said "C" shaped configuration being cuff-like, said outer enclosure means having an outside surface and an inside surface;

a first liner means, said first liner means being a protective member, said first liner means being "C" shaped in configuration, said first liner means having an outside and an inside surface, said first liner means being located within the inside of said outer enclosure means, said outside surface of said first liner means interfacing with and being suitably affixed to said inside surface of said outer enclosure means, said first liner means being slightly longer longitudinally than said outside enclosure means so that said first liner means projects slightly beyond the edges of said outside enclosure means;

a second liner means, said second liner means being a protective member for a user, said second liner means being "C" shaped in configuration, said second liner means having an outside and an inside surface, said second liner means being located within the inside of said first liner means, said outside surface of said second liner means interfacing with and being suitably affixed to said inside surface of said first liner means, said second liner means being slightly longer longitudinally than said first liner means so that said second liner means projects slightly beyond the edges of said first enclosure means;

a support means, said support means providing support for an additional element of said apparatus, said support means being a pair of arm-like members, said arm-like members each having a first end and a second end, one of said pair of arm-like members being located on each of the opposite sides of said outer enclosure means, each said arm-like member being pivotally affixed by suitable means at said first end thereof to said outer enclosure means;

a hand grip means, said hand grip means being for gripping by a user, said hand grip means being cylindrical and rod-like, said hand grip means being located and pivotally affixed by suitable means between said second ends of said pair of arm-like support members;

a positioning means, said positioning means serving as a positioner for an additional element of said apparatus, said positioning means encircling said outer enclosure means on the outside thereof, said positioning means encircling said outer enclosure means and being shaped in a non-circular but symmetrical configuration about a vertical center line through said enclosure means, said positioning means being rectangular in cross section, said positioning means being centrally located transversely across and suitably affixed to the top of said enclosure means, said top of said enclosure means being that portion of said enclosure means that is uppermost when the open portion of said "C" shaped configuration is located downwardly said positioning means being spaced from said open portion of said "C" shaped configuration;

a weight means, said weight means providing a variation in the weight of said apparatus; and a connecting means, said connecting means serving as a connecting member, said connecting means connecting said weight means to said positioning means.

2. An apparatus as recited in claim 1, wherein said apparatus is an exercise device.

3. An apparatus as recited in claim 2, wherein said exercise device is for arm development and conditioning.

4. An apparatus as recited in claim 1, wherein said outer enclosure means is of a very hard texture, said first liner means is of a hard texture and resilient, and said second liner means is of a very soft and resilient texture.

5. An apparatus as recited in claim 1, wherein said non-circular but symmetrical configuration of said positioning means is generally "U" shaped in configuration at the top portion thereof across top of said enclosure means, and generally "V" shaped in configuration at the bottom portion thereof where said positioning means passes under and is spaced from that portion of said "C" shaped configuration that is open.

6. An apparatus as recited in claim 5, wherein said positioning means is further shaped in configuration at three points thereof, the first of said three points being at the bottom of said generally "V" shaped configuration, and the other two points being at the two upper extremities of said generally "V" shaped configuration where said generally "V" shaped configuration meets and joins the two extremities of said generally "U" shaped configuration, said further shape in configuration at said three points each being generally the shape of a "U", each said "U" at said three points forming a recess in said positioning means.

7. An apparatus as recited in claim 6, wherein said weight means consists of:

a flange member, said flange member being flat and plate-like in configuration;

a post member, said post member having a first end and a second end, said post member being cylindrical in configuration, said post member being centrally located on and having said first end thereof suitably affixed to said flange member;

a connection member, said connection member being ring-like in configuration, said connection member being located on and suitably affixed to said second end of said post member; and a plurality of weight members, said plurality of weight members being in a range of sizes by individual weight, said weight members each being disc-like and each having an aperture therein and therethrough, said aperture being centrally located in each said weight member, said aperture being used to place the respective weight member over and on said post member, a stacking of combinations of said range of sizes of said weights being thereby available by choice to a user.

8. An apparatus as recited in claim 7, and additionally, a collar member, said collar member being centrally located on said flange member and surrounding said post member at said first end thereof, said collar means being used for suitably affixing said post member to said flange member.

9. An apparatus as recited in claim 8, wherein said connecting means consists of:

a flexible joining member, said flexible joining member having a first end and a second end;

a first connecting link, said first connecting link being suitabIy affixed to said first end of said flexible joining member; and a second connecting link, said second connecting link being suitably affixed to said second end of said flexible member.

10. An apparatus as recited in claim 9, wherein said first and second connecting links are of the snap type, said first connecting link being removably affixed to said positioning means, said second connecting link being removably affixed to said connection member of said weight means, said first connecting link affixed to said positioning means being slidingly movable upon and along said positioning means, said first connecting link being capable of being positioned and set within any one of said "U" shaped recesses as said first connecting link is slidingly moved along said positioning means, said apparatus being put to use with said first connecting link being set in one of said recesses that has been selected for an associated exercise.

* * * * *